United States Patent [19]

Morooka et al.

[11] 4,004,138

[45] Jan. 18, 1977

[54] METHOD OF AND SYSTEM FOR CONTROLLING TEMPERATURE OF CONTINUOUS FURNACE

[75] Inventors: Yasuo Morooka; Mikihiko Onari; Hidehiro Kitanosono, all of Hitachi, Japan

[73] Assignee: Hitachi, Ltd., Japan

[22] Filed: May 13, 1974

[21] Appl. No.: 469,676

Related U.S. Application Data

[63] Continuation-in-part of Ser. No. 253,837, May 16, 1972, abandoned.

[52] U.S. Cl. ..... 235/151.1; 266/80; 266/87; 236/46 R; 236/78 A; 432/51; 432/53

[51] Int. Cl.[2] ..... F27B 9/40

[58] Field of Search ..... 236/15 B; 432/51, 53; 235/151.1; 266/5 T

[56] References Cited

UNITED STATES PATENTS

| | | | |
|---|---|---|---|
| 3,548,171 | 12/1970 | Kodz | 235/151.1 |
| 3,604,695 | 9/1971 | Steeper | 266/5 T |

*Primary Examiner*—Eugene G. Botz
*Attorney, Agent, or Firm*—Craig & Antonelli

[57] ABSTRACT

A method of and system for controlling the temperature of a continuous furnace through which steel bodies are transported at a constant speed, in which the temperature is controlled so as to keep the distance from the entry port of the furnace to a position in the furnace where the furnace temperature is substantially equal to the desired delivery temperature of a steel body to be heated at a predetermined value which is determined in accordance with the dwell time, shape and size of the steel body.

10 Claims, 4 Drawing Figures

METHOD OF AND SYSTEM FOR CONTROLLING TEMPERATURE OF CONTINUOUS FURNACE

CROSS-REFERENCE TO RELATED APPLICATION

This application is a continuation-in-part application of the copending U.S. Application Ser. No. 253,837, filed on May 16, 1972 now abandoned.

The present invention relates to temperature control of a continuous furnace through which steel bodies are transported at a constant speed.

In the past, the temperature control of materials in a furnace in such a manner that the materials are maintained at a constant temperature for a predetermined duration of time and at a predetermined delivery temperature was performed by controlling the dwell time of the materials in the furnace.

However, for a continuous furnace in which materials are continuously heated to be supplied to a succeeding rolling line, if the material feed pace of the furnace varies while the rolling line is operating at a predetermined pace, the time during which each material passes through or is exposed to the space between the furnace and the rolling mill varies. As a result, the temperature of the material varies so that not only a predetermined entry temperature of the material in the rolling mill can no longer be ensured, but also the rolling efficiency is reduced. Consequently, the dwell time of the material in the furnace cannot be adjusted for the purpose of temperature control. The dwell time is determined in fact by the rolling pitch (rolling ability) of the rolling mill. Consequently, it is necessary to provide a predetermined delivery temperature at a given constant dwell time.

Therefore, an object of the present invention is to control the temperature distribution in a furnace so that a required delivery temperature and a good soaking are provided at a predetermined dwell time of a material in the furnace.

According to the present invention this object is achieved by adjusting the temperature controlling burner of the preheating zone or heating zone in the furnace so as to keep the distance from the entry port of the furnace to a position in the furnace where the furnace temperature is substantially equal to the desired delivery temperature of a material to be heated at a predetermined value which is determined in accordance with the shape and size of the material to be heated at a predetermined dwell time.

The present invention will become more apparent from the following detailed description of a preferred embodiment of the invention when taken in conjunction with the accompanying drawings, in which.

Generally, there is the following formula, known as the Hays formula, between the thickness of a body of steel and the dwell time thereof in a furnace:

$$t = K \frac{H}{a + bH} \tag{1}$$

where $t$ is a dwell time in hours,

K is a proportionality constant (Hays coefficient),

H is the thickness of a body steel in millimeter, and $a$ and $b$ are constants.

The proportional constant K is in an intimate relationship with the temperature distribution in the furnace.

Figure 1:
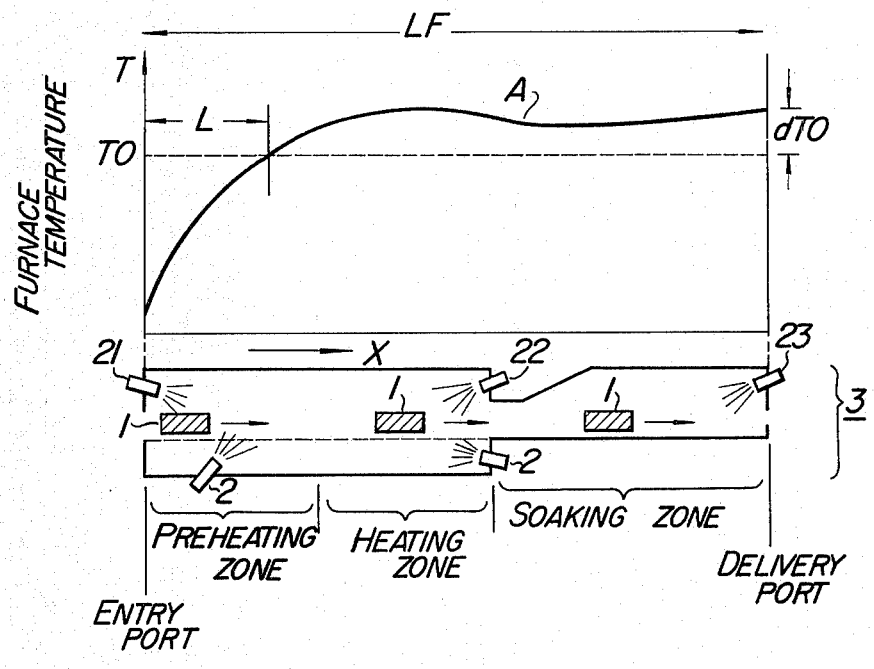
FIG. 1 is a schematic diagram of a furnace and a temperature distribution therein.

FIG. 1 shows a three zone furnace 3 having five burners 2 and 21 to 23 and the temperature distribution A therein. Bodies 1 of steel are entered in the furnace 3 from the entry side thereof and, after passing through a preheating zone, a heating zone, and a soaking zone, delivered from the delivery side thereof. While the bodies 1 of steel successively pass through these zones in the furnace 3 they are heated in accordance with the temperature distribution A in the furnace.

The distance from the entry port of the furnace to the position in the furnace at which the temperature of the furnace is equal to a desired delivery temperature TO of the steel body 1 is utilized in the present invention as a target for controlling the temperature distribution in the furnace and represented by L. If the whole length of the furnace is represented by LF, there is a relation as shown in FIG. 2 between the proportionality constant K and the heat pattern coefficient KF = L/LF.

Figure 2:
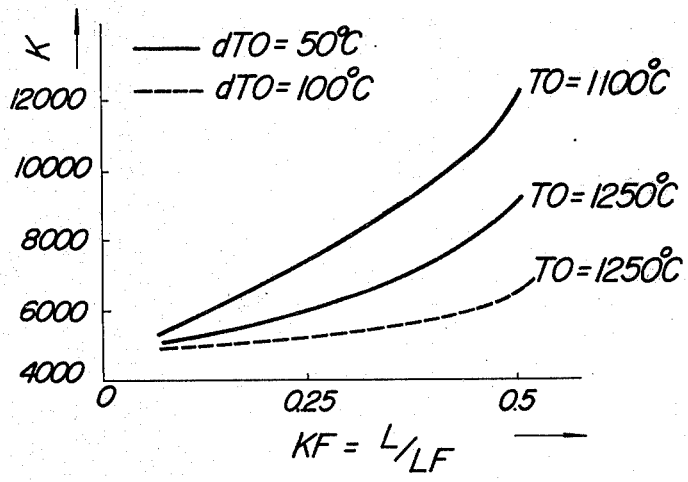
FIG. 2 is a graph showing the relation between the heat pattern coefficient and the Hays coefficient.

It is well known that regarding the thickness H of the steel body, the dwell time $t$, the delivery temperature TO of the steel body, and the temperature difference dTO between the internal temperature of the steel body and the temperature of the furnace at the time of delivery, in other words, dTO is a difference between the surface and internal temperatures of the steel body, there are the relations as shown in Equation (1) and FIG. 2. Further, the dTO is a value predetermined by the experience of a skillful engineer.

The present invention is intended to efficiently control the temperature of a furnace in relation to other lines such as the succeeding rolling mill by utilizing the above relations.

Figure 3:
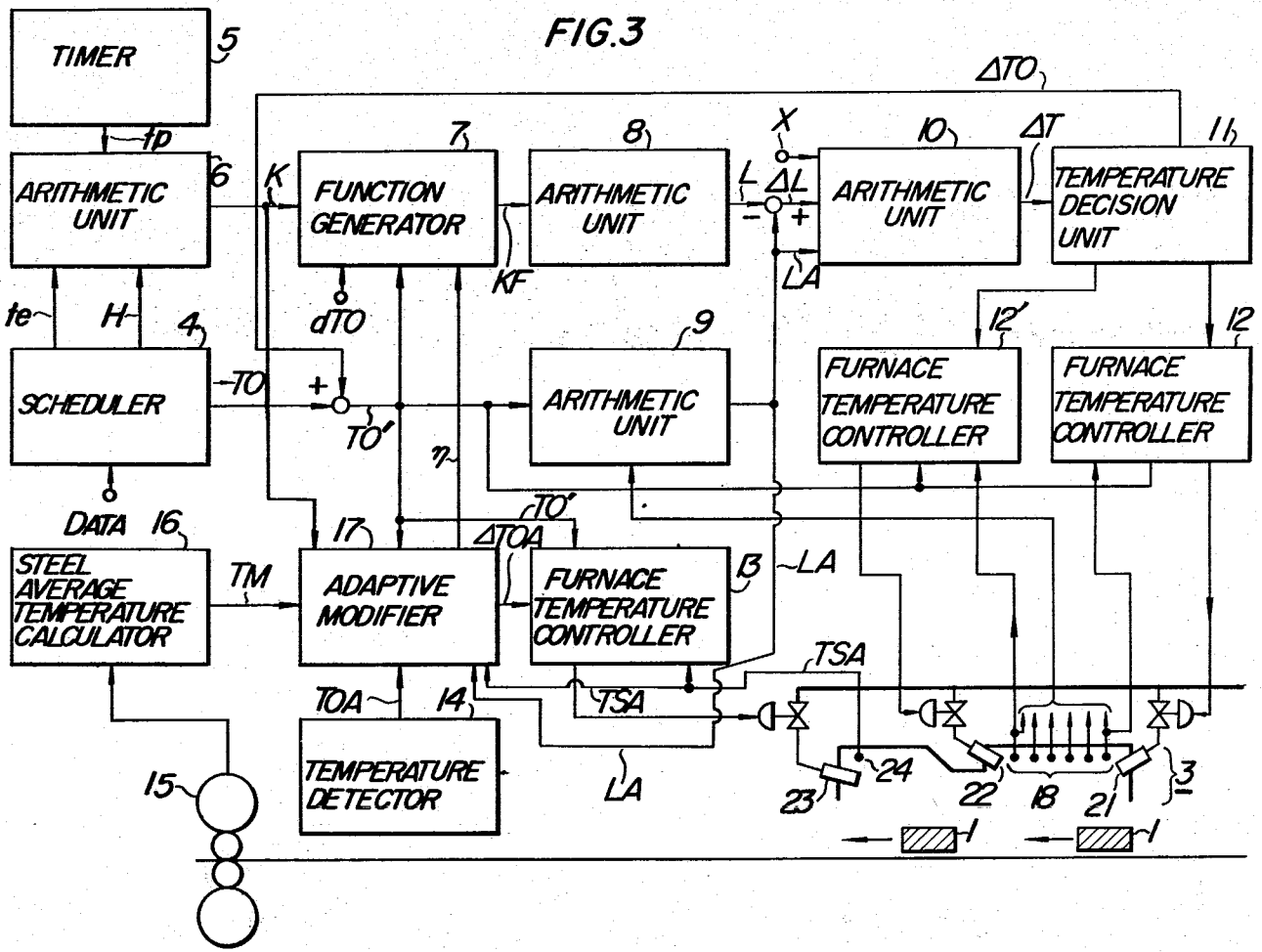
FIG. 3 is an embodiment of the present invention.

An embodiment of the present invention will now be described with reference to FIG. 3, in which reference numberals 1 to 3 designate similar parts to those in FIG. 1. Numeral 4 designates a scheduler. The scheduler 4 is a computer which stores or calculates various parameters in rolling work and delivers the stored and/or calculated parameters, for determining the rolling schedule, the rolling pitch and the desired delivery temperature of a newly entered steel body 1 from the rolling specification of the steel body 1 such as, for example, the plate width, the plate length, the weight and the kind of steel and the desired finishing temperature of a rolling mill 15. Numeral 5 designates a timer, and numeral 6 designates an arithmetic unit for calculating the proportionality constant K, which represents the ease of heating, from the thickness of the steel plate and the dwell time in the furnace by the use of the Equations $$K = t \frac{a + bH}{H}, \tag{2}$$

$$t = t^{-1} + t_e - t_p \tag{3}$$

$$t = t^{-1} + t_e - t_p \quad (3)$$

where $K$ is the proportionality constant,
$t$ is the required dwell time,
$t^{-1}$ is the dwell time of the preceding steel plate,
$t_e$ is the rolling pitch of the rolling mill 15,
$t_p$ is the steel plate feeding pitch to the furnace 3,
$H$ is the thickness of the steel plate, and
$a$ and $b$ are constants determined from the shape and size of the steel body.

Numeral 7 designates a function generator for generating a heat pattern coefficient KF in accordance with functional equations representative of characteristic curves as shown in FIG. 2. The function generator 7 functions to calculate a heat pattern coefficient KF from the Hays coefficient K, the TO′ and dTO as shown in the following Equation:

$$KF = \eta \cdot f(K.TO'.dTO)$$

where $\eta$ is an adaptively modifying coefficient applied to the function generator 7 as an output of an adaptive modifier 17, and $\eta$ means the ratio of the actual value to the prediction of KF. The *TO′* is the modified value of the predetermined delivery temperature *TO*. Numeral 8 designates an arithmetic unit for calculating a target value L of the distance in accordance with the Equation L = KF . LF. The LF is a whole length of the furnace 3 Numeral 9 designates an arithmetic unit for calculating the actual value LA of the distance from the temperature distribution determined by detecting the actual temperatures in the furnace by a detector means 18. Numeral 10 designates an arithmetic unit for calculating a difference ΔT between the target temperature and actual temperature of the furnace at the temperature control points from a difference ΔL(= LA − L) between the target and actual value of the distance, in accordance with the following Equation:

$$\begin{aligned} \Delta T &= \alpha' \left( \frac{1}{L} - \frac{1}{LA} \right) \cdot X \\ &= \alpha' \frac{X}{(LA)^2} \cdot \frac{\Delta L}{1 - \Delta L/LA} \\ &\approx \alpha' \cdot \frac{X}{(LA)^2} \cdot \Delta L \end{aligned} \quad (4)$$

where $\alpha'$ is a proportionality constant X is a distance from the entry port to a predetermined position in the furnace.

Figure 4:
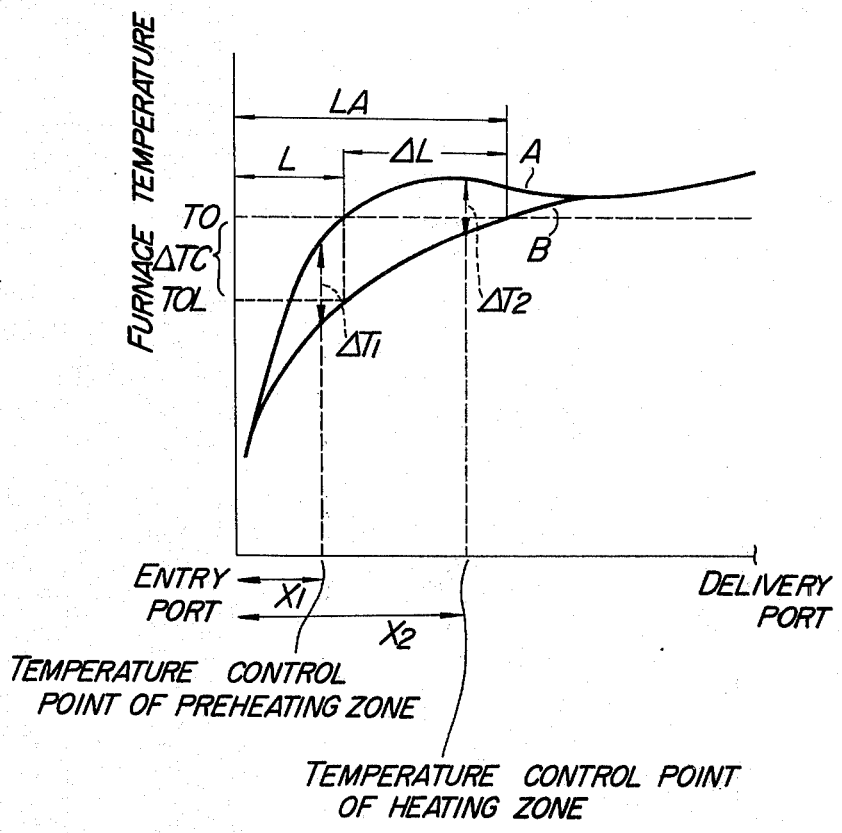
FIG. 4 is a graph showing a modification of a temperature distribution in a furnace.

Referring to FIG. 4, the arithmetic unit 10 functions to calculate the differences $\Delta T_1$ and $\Delta T_2$ at the temperature control points $X_1$ and $X_2$ to output them to a delivery temperature decision unit, wherein $X_1$ and $X_2$ are respectively the distances from the entry port to the first and last sensing elements of a sensing group 18. Numeral 11 designates a delivery temperature decision unit for calculating a temperature difference value ΔTC from the output ΔT of the arithmetic unit 10. As shown in FIG. 4, the ΔTC is a difference of the temperature between the desired delivery temperature TO of the steel body and the actual temperature TOL of the steel body at the target value L of the distance from the entry port of the furnace. When the value ΔTC exceeds upwardly a predetermined tolerance limit the delivery temperature decision unit 11 outputs a variance ΔTO ΔT/2 to modify the desired delivery temperature TO of a newly entered steel body. Therefore, the ΔTO is fed back to the function generator 7 to calibrate the predetermined delivery temperature TO, the heat pattern coefficient KF and the target value L of the distance. The variance ΔTO modifies the delivery temperature TO to the TO′. On the other hand, when the variance ΔTO is the value within the predetermined tolerance limit the delivery temperature decision unit 11 outputs the output signals corresponding to the $\Delta T_1$ and $\Delta T_2$ at the temperature control points of the preheating and heating zones respectively to furnace temperature controllers 12 and 12′ in order to control burners 21 and 22. The furnace temperature controllers 12 and 12′ control the preheating zone and the heating zone of the furnace 3 by adjusting the flow rates of a fuel such as oil or gas for burners 21 and 22, respectively, numeral 13 designates a furnace temperature controller for controlling a burner 23 for the soaking zone, numeral 14 designates a temperature detector for detecting the actual temperature TOA of the heated steel body at the time of delivery, numeral 15 designates a coarse rolling mill, and numeral 16 designates a steel average temperature calculator for taking in the actual rolling load during the rolling operation of the coarse rolling mill 15 to output the average temperature TM of the steel body. Numeral 17 designates an adaptive modifier. The adaptive modifier 17 functions to calculate an adaptively modifying coefficient $\eta$ from the following Equation in order to calibrate the output KF of the function generator 7 by the adaptively modifying coefficient $\eta$ applied to the function generator 7:

$$\eta = \frac{KFA}{f(K \cdot TOA \cdot dTOA)}$$

where the actual value KFA of the heat pattern coefficient KF is obtained from the actual value LA of the distance output from the arithmetic unit 9 by the following Equation.

$$KFA = \frac{LA}{LF}$$

The dTOA is a difference of the temperature between the temperature TOA detected by the detector 14 and the temperature TSA of the soaking zone detected by the detector 24. The difference dTOA is also obtain from a difference of the temperature between the average temperature TM of the steel body output from the steel average temperature calculator 16 and the actual temperature TOA of the steel body detected by the detector 14 in accordance with the following Equation:

$$dTOA = \alpha \cdot (TOA - TM)$$

where $\alpha$ is a proportionality constant. Further the adaptive modifier 17 functions to calculate the difference signal ΔTOA of the temperature between the temperature TOA and TO′ and to apply the difference signal ΔTOA to the furnace temperature controller 13 in order to control the burner 23. The temperature detectors 18 detect the temperature distribution in the heating and preheating zones.

In operation, upon entrance of a steel body 1 in the furnace 3, the scheduler 4 decides a desired delivery temperature TO from the rolling specification by predicting the temperature drops at the coarse rolling mill 15 and a succeeding finishing rolling mill (not shown). The decision may be made by a method well known in the art. The scheduler 4 decides also the delivery internal $t_e$ of the steel bodies taking the time necessary for modifying the rolling setting and the characteristics of the rolling mill such as power consumption into consideration and the thickness H of the steel body to supply them to the arithmetic unit 6. The arithmetic unit 6 detects the entry interval $t_p$ of the steel bodies from the timer 5 to decide the dwell time of the steel body in the furnace 3 by Equation (3) and to calculate the proportionality constant K from the input of H, $t_e$ and $t_p$ derived from the scheduler 4 and the timer 5 in accordance with the Equations (2) and (3).

The larger the proportionality constant K, the longer the dwell time if the shape and size of the steel body are constant. Thus, the proportionality constant K is so to speak a constant representing the degree of incapability of the steel body of being heated. When the output K of the arithmetic unit 6 is supplied to the function generator 7, the function generator 7 functions to calculate the heat pattern coefficient KF which is represented by the characteristic curves in FIG. 2. The function generator 7 stores a number of patterns considering the necessary difference between the temperature of the steel body and the temperatures of the furnace for each desired delivery temperature TO. These patterns may well be empirical data. The arithmetic unit 8 provides a target value of the distance L(= LF . KF) from the heat pattern coefficient KF. Thus, the components 4 to 8 predictively calculate the target value L of the distance from the entry port of the furnace to a position in the furnace where the furnace temperature is substantially equal to the desired delivery temperature of a steel body to be heated. The value L is necessary for bringing the steel body to the desired delivery temperature from the predetermined specification of the steel body.

The arithmetic unit 9 detects the actual temperature of the furnace by the detector 18 and determine and actual value LA of the distance from the entry port of the furnace to the point in the furnace at which the temperature is in agreement with the desired delivery temperature TO. A difference distance value ΔL is formed by the summing unit at the output of arithmetic units 8 and 9 and supplied to the arithmetic unit 10 which calculates ΔT which is a temperature value required for calibration of the temperature distribution in the furnace in accordance with the distance difference value ΔL.

Referring to FIG. 4, the target value L of the distance determined from the assumed heat pattern A and the desired delivery temperature TO of the steel body is calculated by the components 4 to 8. On the other hand, the actual heat pattern detected by the detector 18 at the preheating zone and the heating zone is as shown at B. Consequently, the actual value of the distance is LA in FIG. 4. By controlling the burner 21 of the preheating zone or burner 22 of the heating zone by means of the furnace temperature controller 12 or 12′, respectively, in accordance with the deviation of the value LA from the value L, the temperature distribution is modified by $\Delta T_1$ and $\Delta T_2$ at the temperature control points of the preheating and heating zones, respectively.

The temperature decision unit 11 operates to supply a temperature control signal to the furnace temperature controllers 12 or 12′ when the temperature difference value ΔTC is below a certain value and applies a temperature control signal ΔTO to the function generator 7 when the temperature difference is above a certain value. In this manner, the original set point for the temperature controllers is raised or lowered thereby providing an immediate control of the entire heating operation of the furnace with smaller variations being effected by control of the individual furnace controllers.

When the steel body 1 is delivered from the furnace 3, the temperature detector 14 detects the surface temperature of the steel body 1 and supplies the detected signal TOA to the adaptive modifier 17. On the other hand, the steel average temperature calculator 16 calculates the average temperature TM of the steel body 1 from the rolling load of the coarse rolling mill 15 and supplies it to the adaptive modifier 17.

The adaptive modifier 17 feeds the adaptively modifying coefficient $\eta$ and the modified delivery temperature TO′ thereof to the function generator 7 for predictive error correction and to the temperature controller 13 for modification of the temperature control of the soaking zone. Additionally, the adaptive modifier 17 is arranged to modify the heat pattern coefficient KF at the output of the function generator in accordance with the actual delivery temperature of the steel body as detected by the temperature detector 14 and the average temperature calculator 16. In this manner, the heating means provided in the preheating and/or heating zones of the furnace are controlled to maintain the distance L at an optimum value determined by the dwell time, shape and size of the steel body and which value is varied in accordance with the properties of the steel body to be heated.

What is claimed is:

1. A method of controlling the temperature of a continuous furnace equipped with a preheating zone temperature controlling burner, a heating zone temperature controlling burner, and a soaking zone temperature controlling burner, including controlling the preheating zone temperature controlling burner or the heating zone temperature controlling burner to keep the distance from the entry port of the furnace to a position in the preheating or heating zone where the furnace temperature is substantially equal to a desired delivery temperature of a body to be heated at a predetermined value which is determined in accordance with at least one of the shape, size and dwell time of the body.

2. A system for controlling the temperature of a continuous furnace, comprising arithmetic unit means for predictively calculating a target value of the distance from entry port to a position in the furnace where the temperature is substantially equal to a desired delivery temperature of a body to be heated based on at least one of the shape, size and dwell time of the body, a heating control unit means for controlling the heating means of the furnace in accordance with the target value calculated by the arithmetic unit means, and modifier means for modifying the target value in accordance with the difference between the actual value of the distance and the target value of the distance.

3. A system for controlling the temperature of a continuous furnace according to claim 2, in which the arithmetic unit means includes means for calculating the proportionally constant (Hays coefficient) K from at least one of the shape, size and dwell time of the body to be heated and function generator means for generating the heat pattern coefficient KF corresponding to the proportionality constant, and the modifier means modifies the heat pattern coefficient KF of the function generator means.

4. A system for controlling the temperature of a continuous furnace equipped with a preheating zone temperature controlling burner, a heating zone temperature controlling burner, and soaking some temperature controlling burner, comprising arithmetic unit means for predictively calculating a target value of the distance from the entry port of the furnace to a position in the furnace where the furnace temperature is substantially equal to a desired delivery temperature of a body to be heated which is determined by controlling the preheating zone temperature controlling burner or the heating zone temperature controlling burner in accordance with at least one of the shape, size and dwell time of the body, heating control unit means for controlling the preheating zone temperature controlling burner or the heating zone temperature controlling burner in accordance with the output of the arithmetic unit means, and adaptive modifier means for modifying the prediction of the target value calculated by the arithmetic unit means in response to the detected the delivery temperature of the furnace.

5. A system for controlling the temperature of a continuous furnace according to claim 4, in which the arithmetic unit means includes means for calculating the proportionality constant (Hays coefficient) K from at least one of the shape, size and dwell time of the body to be heated and function generator means for generating the heat pattern coefficient KF corresponding to the proportionality constant, and the adaptive modifier means modifies the heat pattern coefficient KF of the function generator.

6. A system for controlling the temperature of a continuous furnace according to claim 2, wherein the modifier means includes adaptive modifier means responsive to the detected delivery temperature of the furnace for controlling the arithmatic unit means.

7. A system for controlling the temperature of a continuous furnace according to claim 2, wherein the modifier means includes temperature detecting means for detecting the actual temperature of the furnace, means for calculating the actual value of the distance, means for comparing the target value and the actual value of the distance and providing a distance difference value output, means for converting the distance difference value output to a temperature difference value, and means responsive to the temperature difference value for providing a modifying value output to one of the arithmatic unit means and the heating control unit means in dependence upon the value of the temperature difference value.

8. A system for controlling the temperature of a continuous furnace according to claim 7, wherein the arithmatic unit means includes means for calculating the proportionality constant (Hays coefficient) K from at least one of the shape, size and dwell time of the body to be heated and function generator means for generating the heat pattern coefficient KF corresponding to the proportionality constant, and the modifier means includes adaptive modifier means responsive to the detected delivery temperature of the furnace for modifying the heat pattern coefficient KF of the function generator means.

9. A system for controlling the temperature of a continuous furnace according to Claim 8, wherein the adaptive modifier means includes temperature detector means for detecting the delivery temperature of the furnace, calculating means for calculating the average temperature of the heated body and means responsive to the temperature detector means and the average temperature calculator means for modifying the heat pattern coefficient KF of the function generator means.

10. A method according to claim 1, wherein the step of controlling includes the steps of predictively calculating a target value of the distance from the entry port to a position in the furnace where the temperature is substantially equal to a desired delivery temperature of the body to be heated based on at least one of the shape, size and dwell time of the body, controlling the preheating zone temperature controlling burner or the heating zone temperature controlling burner in accordance with the target value calculated, and modifying the target value in accordance with the difference between the actual value of the distance and the target value of the distance.

* * * * *